US006776627B2

(12) United States Patent
Hohner

(10) Patent No.: US 6,776,627 B2
(45) Date of Patent: Aug. 17, 2004

(54) MULTI-POLE CONNECTOR WITH PROTECTIVE GROUND

(75) Inventor: Manfred Hohner, Viereth-Trunstadt (DE)

(73) Assignee: Wieland Electric GmbH, Munich (DE)

( * ) Notice: Subject to any disclaimer, the term of this patent is extended or adjusted under 35 U.S.C. 154(b) by 146 days.

(21) Appl. No.: 10/012,173

(22) Filed: Oct. 29, 2001

(65) Prior Publication Data

US 2002/0081875 A1 Jun. 27, 2002

(30) Foreign Application Priority Data

Oct. 27, 2000 (DE) ..... 100 53 300

(51) Int. Cl.[7] ..... H01R 4/66

(52) U.S. Cl. ..... 439/92; 439/567; 439/571; 439/939

(58) Field of Search ..... 439/939, 92, 567, 439/571, 607

(56) References Cited

U.S. PATENT DOCUMENTS 4,728,295 A * 3/1988 Henrici et al. ..... 439/84

4,943,244 A * 7/1990 Teck et al. ..... 439/567

FOREIGN PATENT DOCUMENTS

| | | |
|---|---|---|
| DE | 94 14 984 U1 | 9/1995 |
| DE | 44 26 541 A1 | 2/1996 |
| EP | 0 327 703 B1 | 8/1989 |
| EP | 0 327 703 A3 | 8/1989 |

* cited by examiner

*Primary Examiner*—P. Austin Bradley
*Assistant Examiner*—Briggitte R. Hammond
(74) *Attorney, Agent, or Firm*—Laurence A. Greenberg; Werner H. Stemer; Gregory L. Mayback

(57) ABSTRACT

An electrical connector that is intended in particular for mounting in a mounting opening in a housing wall of a light housing is described. For this purpose, the connector has a holding element that is at the same time in the form of a protective-ground conductor contact. The holding element preferably has a holding spring and a contact part which acts as a protective-ground conductor contact and is configured such that the protective-ground contact is mounted and formed automatically by insertion of the connector into the mounting opening.

12 Claims, 3 Drawing Sheets

MULTI-POLE CONNECTOR WITH PROTECTIVE GROUND

BACKGROUND OF THE INVENTION

1. Field of the Invention

The invention relates to a multipole electrical connector, which is intended for mounting in an opening in a housing wall, in particular a housing wall of a light housing.

Such a connector is used, for example, in a light strip or else in a light array. The expression light strip refers to a number of light elements that are linked to one another. Each of the light elements has an associated light housing. The individual light elements are generally connected via a connecting line or tapping line to a common supply line, in order to supply them with electrical power. The connecting line is in this case connected to the supply line via the multipole connector. The connector, which can also be referred to as a connecting distributor, is generally disposed in the immediate vicinity of the light element and connects two pieces of the supply line to one another. The connector is in this case mounted in a mounting opening in the light housing. However, the connector is not restricted to use for a light strip, and is generally suitable for connection of electrical appliances to a supply line, especially in a building installation system.

A light strip having an electrical plug connector or plug distributor is known from German Patent DE 94 14 984 U1. The plug distributor described in that document has a T-shaped cross section. The two sides of its transverse limb each have a conductor connection, to be precise in the form of a plug pin on one side and in the form of a plug socket on the other side, for further connection to further lights. The plug pin and the plug socket form a plug connector system, using which two pieces of the supply line are connected to one another. The plug connector system has, in particular, system plugs, which ensure simple connection without any faults. The incoming supply line is, for example, connected to the plug pins, and the outgoing supply line is connected to the plug sockets.

The longitudinal limb of the T-shaped plug distributor is intended for use as a tapping contact for the connection of the respective light element. The tapping contact is, in particular, likewise in the form of a system plug, which makes it possible to connect the light element easily and quickly.

The known T-shaped plug connector is preferably a part of a comprehensive connection system for connection of light elements. The connecting system is formed overall on the basis of the "plug and play" concept, thus allowing simple installation and, in particular, very quick installation, in situ when installing the light strip.

In order to supply electrical power to the light element disposed inside the light housing, it must be connected to the supply line running outside the light housing. To do this, the connector is generally disposed in a mounting opening in the rear wall of the light housing. A certain amount of installation effort is involved in mounting the connector in the mounting opening.

European Patent EP 0 327 703 B1 discloses a connecting terminal for electrical appliances such as lights, cookers, washing machines etc., which is intended for mounting on a terminal base. The connector terminal has an opening through which a stamped and bent sheet-metal part extends when the connecting terminal is fitted. The bent sheet-metal part is used to produce a contact-making connection to the terminal base, in order to form a protective-ground conductor contact. For this purpose, the end faces of the stamped and bent sheet-metal part are pressed against the opening edge of the opening. The stamped and bent sheet-metal part has two latching tongues, which spread apart after passing through the opening and thus form barbs, which are supported against the inner surface of the terminal base. The stamped and bent sheet-metal part thus additionally secures the connecting terminal on the terminal base. However, such a configuration requires the stamped and bent sheet-metal part to be disposed in a central region of the connecting terminal, which has to cover a large proportion of the terminal base.

SUMMARY OF THE INVENTION

It is accordingly an object of the invention to provide a connector which overcomes the above-mentioned disadvantages of the prior art devices of this general type, which allows the connector to be fitted in a simple manner.

With the foregoing and other objects in view there is provided, in accordance with the invention, a multipole electrical connector. The multipole electrical connector includes a holding element for mounting in a mounting opening in a housing wall. The holding element has a holding spring with an outward bulge to form a recessed grip with the housing wall. The holding element further has a protective-ground conductor contact.

Thus, initially, the holding element has two functions. Specifically, it is used first as a mounting device for the connector and, second, it is used as a protective-ground conductor contact, by producing an electrically conductive connection to the light housing. The double function results in that only one installation step is required, where two installation steps were necessary in the past, namely, first, the mounting of the connector and, second, the connection of the protective-ground conductor contact to the housing. The installation effort and the costs are thus kept low.

The holding spring allows the connector to be mounted in the mounting opening in a particularly simple, reliable and automatic manner, simply by pushing it in. The outward bulge results in that the holding spring is in the form of an edge grounding bracket as is provided, for example, in German-Standard plug sockets with a ground connection. This thus engages around the edge of the mounting opening. This achieves the major advantage that the holding element can be provided on the edge of the connector, and can be disposed in the final mounted position between this and the edge of the mounting opening. The holding spring thus in this case clamps the connector in the mounting opening and holds it there in a captive manner owing to the configuration of the recessed grip. The configuration at the edge results in that, in the extreme, the area of the mounting opening can be as large as, or even slightly larger than, the cross-sectional area of the connector. This results in the advantageous capability to provide the connection with connecting units that are accessible on both sides, without adversely affecting its accessibility through the housing wall. In this case, the expression accessible on both sides refers to a connecting unit that is accessible from outside the light housing, and a connecting unit that is accessible from inside the light housing.

In contrast to a configuration with latching tongues formed like barbs, which spread against the inside of the housing wall, this also achieves the advantage that, when required, the connecting terminal can be removed from the mounting opening once again, without any major effort.

In order to achieve a particularly reliable electrical contact with the housing, the holding spring, in one advantageous refinement, has sharp edges and/or is profiled. It therefore penetrates through any varnish layers or else oxidation layers that there may be on the housing.

The holding spring is preferably approximately U-shaped with two side limbs, with each side limb having an outward bulge to form a recessed grip with the housing wall. The holding spring is thus in the form of a double spring clip, thus resulting in a particularly robust configuration and in the connector being held particularly reliably in the mounting opening.

According to one preferred embodiment, the holding element has a contact part that acts as a protective-ground conductor contact and has a cutting element pointing outward in the direction of the housing wall. The contact part is in this case in particular in the form of a component that acts separately from the holding spring, so that both the holding spring and the contact part can be configured in a particularly suitable manner with regard to their respective function.

In this case, the cutting element, and in particular the contact part together with the cutting element, are advantageously held elastically. This ensures that the cutting element is pressed against the housing wall, that is to say it exerts as high a contact pressure as possible, to form a reliable protective-ground contact. At the same time, the elastic or sprung mounting is used to ensure that the cutting element is pressed through any varnish layer that may be present. In particular, the contact part is configured to be elastic independently of the holding spring. Its functions, including the function of making contact with the contact part and the function of holding the holding spring (which, in addition, can also carry out a contact-making function), are thus reliably ensured separately from one another, to be precise irrespective of the tolerances of the connector in relation to the mounting opening, and irrespective of the thickness of the sheet metal of the housing wall.

In order to achieve a configuration which is as cost-effective as possible and can be produced as easily as possible, the holding spring and the contact part are in the form of an integral stamped and bent part.

In order to mount it securely in the mounting opening, the connector expediently has a holding element on at least two opposite sides. The mounting function is preferably carried out exclusively by the holding elements, and no further mounting device is required.

In order to achieve a configuration that is simple and cost-effective, the two holding elements are connected to one another via a connecting bracket that is, in particular, H-shaped. The duplicated configuration of the holding elements and their direct connection via an electrically conductive connecting bracket mean that the function of the protective-ground contact has a redundant configuration. Even if one of the holding elements does not make suitable contact with the housing wall, the protective-ground contact function is ensured by the second holding element.

The two holding elements are preferably in the form of a common, integral stamped and bent part in order to achieve a configuration which is simple to produce. Before the stamping and bending process, the work piece is in this case, in particular, in the form of an approximately rectangular and flat piece of metal. The holding springs are each stamped out and formed as a U-shaped bracket at its two opposite ends, and the respective contact parts are stamped out and formed from the inner region of the U-shaped brackets.

The connecting bracket is advantageously disposed such that it runs transversely on a connector base platform, with the holding elements in each case being bent out approximately at right angles at the edge of the connector base platform. This results in good guidance and retention of the holding elements on an insulating housing having the connector base platform.

The connecting bracket expediently has a clamping opening into which a contact pin of an associated protective-ground conductor connection is inserted. The electrical connection between the protective-ground conductor contact provided by the contact part and a protective-ground conductor inserted into the connector is thus produced in a simple manner, by use of a plug-in clamping connection.

Other features which are considered as characteristic for the invention are set forth in the appended claims.

Although the invention is illustrated and described herein as embodied in a connector, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
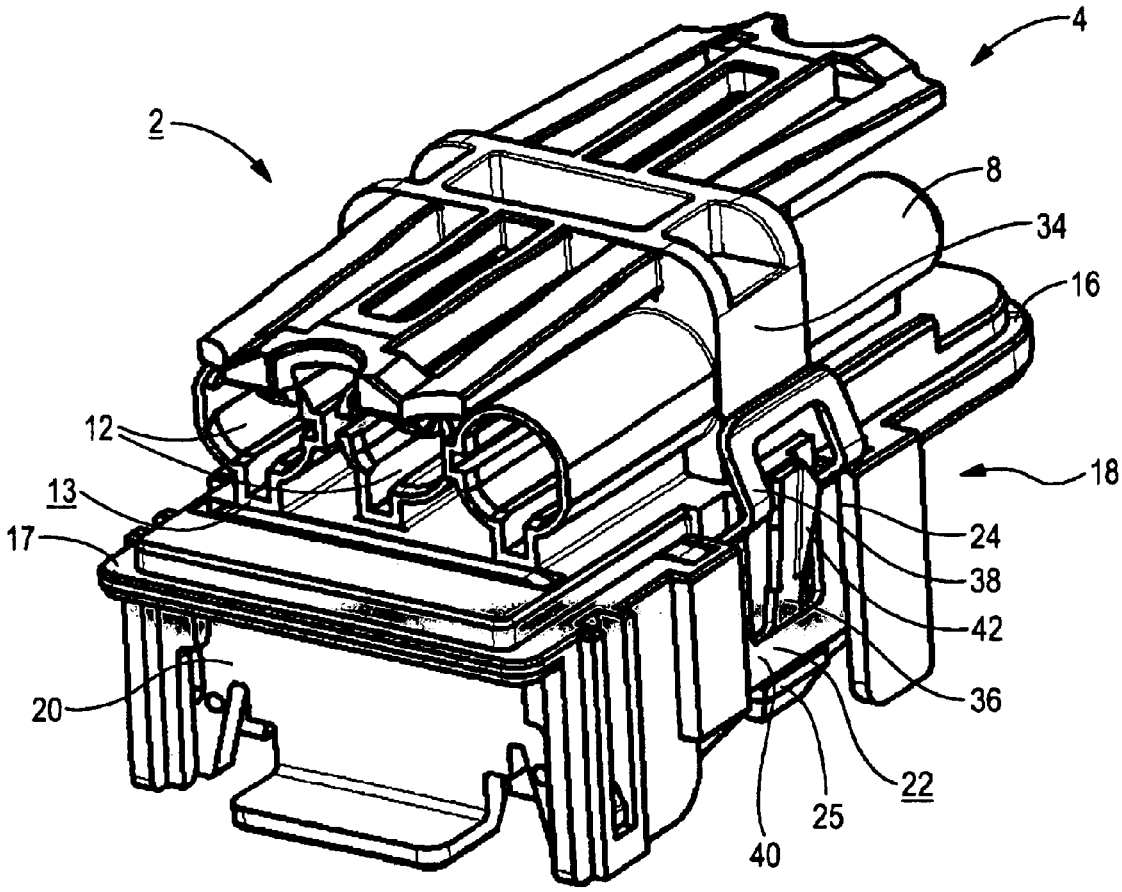
FIG. 1 is a diagrammatic, top perspective view of a connector having a holding element for mounting in a mounting opening in a housing wall according to the invention.

Referring now to the figures of the drawing in detail and first, particularly, to FIG. 1 thereof, there is shown a three-pole connector 2 that has a first connecting unit 4 with a plug contact system. The plug contact system is used to produce a simple and quick connection between the connector 2 and a supply line, which is not shown, via line connections. These are formed by plug sockets 8 on an output side, and by opposite plug pins 12 on an input side. The connector 2 has an insulating housing 13 with a connector platform 16, which splits the connector 2 horizontally. The connector platform 16 has a circumferential mounting stop 17. The first connecting unit 4 is disposed on an upper face of the connector platform 16, and a second connecting unit 18 is provided on a lower face of the connector platform 16. The second connecting unit 18 preferably has a further connecting system, which is not the same as the connecting system of the first connecting unit 4. It is thus possible to combine two different connecting systems by use of the connector 2. For safety reasons, the connector 2 has a sliding flap 20 that covers the line connection of the first connecting unit 4 or the second connecting unit 18 such that they are inaccessible when the conductor connections of the other connecting unit 18 or 4 are in use. In the exemplary embodiment shown in FIG. 1, the sliding flap 20 covers the input-side conductor connections of the second connecting unit 18. The conductor connections of the first connecting unit 4 are accessible, in the form of the plug pins 12. The mutually associated conductor connections of the respective connecting unit 4, 18 are each electrically connected to one another, and are at the same electrical potential. The sliding flap 20 provides a protection mechanism so that a conductor connection that is not in use but is live is inaccessible.

A holding element 22 is provided on an end face of the connector 2 and is held in a guide 24 formed by the insulating housing 13. The holding element 22 is supported on a stop 25 and is used for mounting the connector 2 in a mounting opening 30 incorporated in a housing wall 28 of a light housing 32 (in this context see FIG. 2).

In addition to its holding function, the holding element 22 also has a protective-ground contact function. For this purpose, it is electrically conductively connected to the housing wall 28 in the final mounted position. At the same time, it is electrically conductively connected to a protective-ground conductor connection provided for a protective-ground conductor.

The holding function of the holding element 22 is carried out by a holding spring 34, and the protective-ground contact function is carried out by a contact part 36.

The holding spring 34 is substantially in the form of a U-shaped bracket, whose side limbs each form an outward bulge 38, which engages behind the housing wall 28 in the final mounted position. The outward bulge 38 results in that the holding element 22 is elastic and resilient.

The contact part 36 is disposed in an interior, which is enclosed by the two side U-limbs. The contact part 36 is in the form of a free-standing web, which is connected to a base piece 40 of the holding element 22. At the same time, the two side U-limbs of the holding spring 34 are also connected to the base piece 40. The contact part 36, which is in the form of a web, has angled cutting elements 42 along an edge, which project from the connector 2 and point toward the housing wall 28. The cutting elements 42 have an approximately triangular shape and have two inclines that run to a point. The cutting elements 42 have sharp edges and thus ensure that a good electrical contact is made with the light housing 32. Even any varnish layer that there may be on the light housing 32 is penetrated by the cutting elements 42. Since the contact part 36 is attached only to the base piece 40, it is held elastically and resiliently, so that a high contact and cutting pressure is achieved during mounting, in particular and additionally owing to the inclined angle of the cutting elements 42. At the same time, this ensures a high contact pressure between the contact part 36 and the housing wall 28 in the final mounted position.

Figure 2:
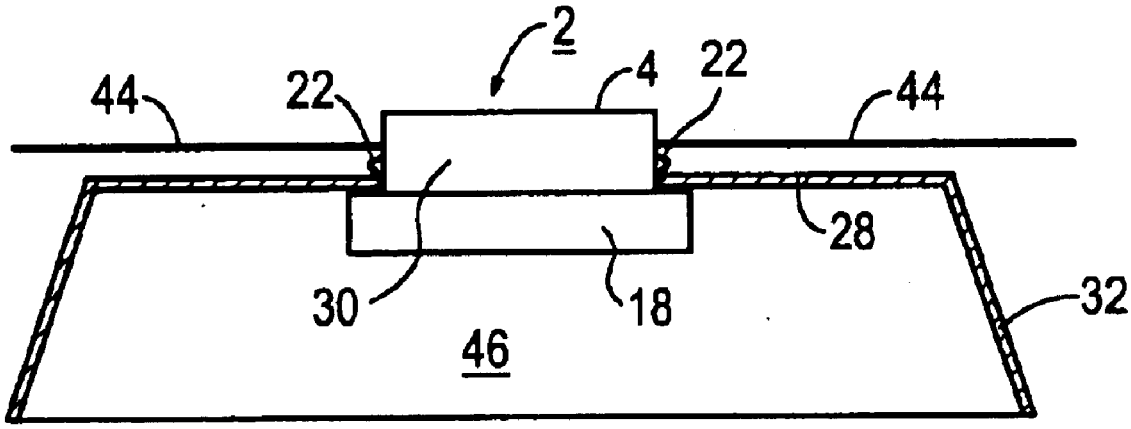
FIG. 2 is an illustration of a configuration of the connector in the mounting opening of a light housing, illustrated in the form of a sketch.

The preferred field of use of the connector 2 will be explained with reference to FIG. 2. To be precise, the connector 2 is intended in particular to be disposed in the mounting opening 30 of the light housing 32, and is used as a connecting system for a supply line 44 for a light strip. The light strip contains a large number of light elements that are connected to one another and which each have an associated light housing 32. The connector 2 is in this case used as a connection for a tapping line, by which the respective light element is supplied with electrical power. For fast and simple installation, the supply line 44 is connected by a plug system to the connector 2, to be precise to the first connecting unit 4. The first connecting unit 4 for this purpose projects through the housing wall 28 and is accessible from the outside, while the second connecting unit 18 is accessible from an interior 46 of the light housing 32. The connector 2 is held securely in the mounting opening 30 by the two mutually opposite holding elements 22. The insulating housing 13 of the connector 2, as well as the holding elements 22, are configured such that the connector 2 is inserted into the mounting opening 30 from the interior 46. The mounting stop 17, for example, is formed in an appropriate manner for this purpose. During insertion into the mounting opening 30, the holding spring 34 is pressed on to the connector 2 and then engages behind the housing wall 28 to provide secure retention, as soon as the connector 2 is supported by the mounting stop 17 against the housing wall 28. During insertion of the connector 2 into the mounting opening 30, the cutting elements 42 in the process automatically cut into the housing wall 28.

Thus, as a result of the insertion of the connector 2 into the mounting opening 30, both the mounting in the mounting opening 30 and the formation of the protective-ground contact via the contact part 36 are achieved at the same time and automatically by the holding elements 22.

Figure 3:
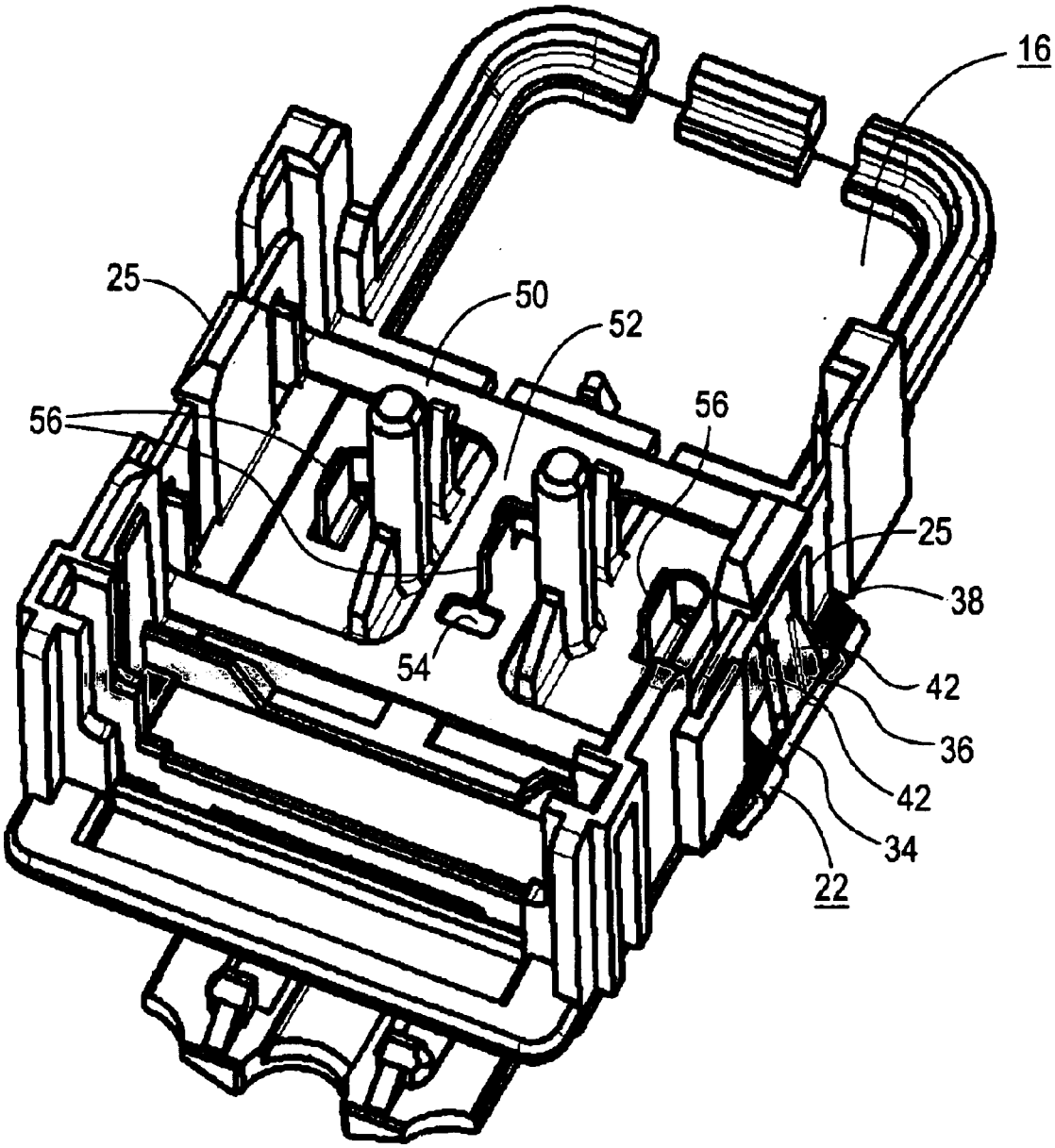
FIG. 3 is a bottom perspective view of the configuration of the holding element on a connector platform of the connector.

As can be seen in FIG. 3, the holding elements 22 are disposed on two opposite edges of the connector platform 16, and are connected to one another via an H-shaped connecting bracket 50. The two holding elements 22 and the connecting bracket 50 in this case form an integral stamped and bent part. The connecting bracket 50 is fitted to the connector platform 16, and the holding elements 22 are each bent out at right angles at the edge.

The H-shaped connecting bracket 50 has a central web 52 with a clamping opening 54. As shown in FIG. 3, a contact pin, which is in the form of a contact tongue 56, is passed through the clamping opening 54 and is used to make electrical contact between a protective-ground conductor connection and the connecting bracket 50.

Figure 4:
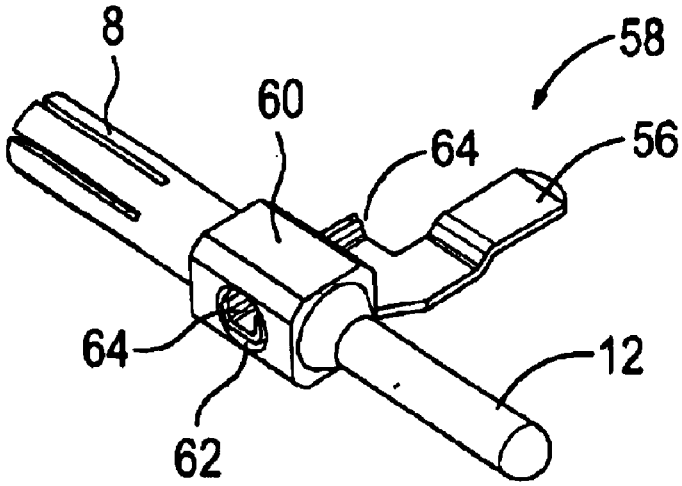
FIG. 4 is a perspective view of a plug contact unit of the connector.

The contact tongue 56 is part of a plug contact unit 58, as can be seen in FIG. 4. A plug contact unit 58 in each case forms the electrical basis of the three poles of the first connecting unit 4. For this purpose, it contains the plug socket 8 and the plug pin 12, which are connected to one another via a center piece 60. The center piece 60 has a central opening 62, into which a foot part 64 of the contact tongue 56 is inserted.

As can be seen from FIG. 1, each pole of the three-pole first connecting unit 4 has an associated plug contact unit 58. The three associated contact tongues 56 thus pass through the connector platform 16. The set contact tongues 56 are at the same time used to make electrical contact with the second connecting unit 18, which is advantageously simply plugged onto the contact tongues 56.

I claim:

1. A multipole electrical connector, comprising:

a connector body having opposite sides;

two holding elements for mounting in a mounting opening in a housing wall, each of said holding elements having a holding spring with an outward bulge to form a recessed grip with the housing wall, each of said holding elements further having a protective-ground conductor contact, each of said holding elements being disposed at one of said opposite sides of said connector body;

a connecting bracket connecting said two holding elements to one another, said connecting bracket having a clamping opening formed therein; and a protective-ground conductor connection having a contact pin inserted in said clamping opening.

2. The connector according to claim 1, wherein said holding spring has sharp edges and is profiled.

3. The connector according to claim 1, wherein said holding spring is U-shaped with two side limbs, each of said two side limbs have said outward bulge to form the recessed grip with the housing wall.

4. The connector according to claim 1, wherein said two holding elements are in a form of an integral stamped and bent part.

5. The connector according to claim 1, including a connector platform having edges and said connecting bracket is disposed on said connector platform such that said connecting bracket runs transversely on said connector platform, and said holding elements are each bent outward approximately at right angles at said edges of said connector platform.

6. The connector according to claim 1, wherein said connecting bracket is H-shaped.

7. The connector according to claim 1, wherein said holding element is configured for mounting in a mounting opening in a housing wall of a light housing.

8. The connector according to claim 1, wherein said holding spring has sharp edges.

9. The connector according to claim 1, wherein said holding spring is profiled.

10. The connector according to claim 1, wherein said holding element has a contact part functioning as said protective-ground conductor contact, said contact part having a cutting element pointing outward in a direction of the housing wall.

11. The connector according to claim 10, wherein said cutting element is held elastically on said holding element.

12. The connector according to claim 10, wherein said holding spring and said contact part are an integral stamped and bent part.

* * * * *